US005961115A

United States Patent [19]

Blanck et al.

[11] Patent Number: 5,961,115

[45] Date of Patent: Oct. 5, 1999

[54] METHOD AND SYSTEM OF SENSING AN OUTPUT LEVEL OF AN OUTPUT STACK OF PRINT MEDIA IN AN IMAGE FORMING APPARATUS

[75] Inventors: Thomas Wilbur Blanck, Nicholasville; Cyrus Bradford Clarke, Lexington; Matthew Lowell McKay, Lexington; Phillip Byron Wright, Lexington, all of Ky.

[73] Assignee: Lexmark International Inc., Lexington, Ky.

[21] Appl. No.: 08/853,681

[22] Filed: May 9, 1997

[51] Int. Cl.[6] ..... B65H 7/12; B65H 7/02; B65H 43/00; B65H 33/04

[52] U.S. Cl. ..... 271/263; 271/265.01; 271/262; 271/176; 271/207; 270/52.06; 270/58.02

[58] Field of Search ..... 271/263, 265.01, 271/262, 278, 176, 207, 3.09, 3.13; 270/52.06, 58.02

[56] References Cited

U.S. PATENT DOCUMENTS

| | | | |
|---|---|---|---|
| 3,968,364 | 7/1976 | Miller | 250/237 R |
| 4,229,650 | 10/1980 | Takahashi et al. | 250/223 R |
| 4,741,526 | 5/1988 | Reed | 271/263 |
| 4,770,405 | 9/1988 | Fukushima et al. | 271/176 |
| 5,097,273 | 3/1992 | Moro et al. | 271/258.01 |
| 5,136,144 | 8/1992 | Swinton et al. | 235/379 |
| 5,139,254 | 8/1992 | Yamashita et al. | 271/215 |
| 5,146,087 | 9/1992 | VanDusen | 250/271 |
| 5,165,678 | 11/1992 | Koseki et al. | 271/157 |
| 5,188,354 | 2/1993 | Emori | 271/217 |
| 5,207,412 | 5/1993 | Coons, Jr. et al. | 270/58 |
| 5,328,169 | 7/1994 | Mandel | 271/298 |
| 5,350,169 | 9/1994 | Hiroi et al. | 271/213 |
| 5,358,238 | 10/1994 | Mandel et al. | 271/298 |
| 5,425,457 | 6/1995 | Williams | 209/547 |
| 5,435,544 | 7/1995 | Mandel | 271/298 |
| 5,547,178 | 8/1996 | Costello | 270/58 |
| 5,551,686 | 9/1996 | Sanchez et al. | 271/298 |
| 5,704,609 | 1/1998 | Mandel et al. | 271/298 |

FOREIGN PATENT DOCUMENTS

| | | | |
|---|---|---|---|
| 0768265 A1 | 4/1997 | European Pat. Off. | B65H 39/11 |

*Primary Examiner*—William E. Terrell
*Assistant Examiner*—Wonki Park
*Attorney, Agent, or Firm*—Taylor & Associates

[57] ABSTRACT

A method of determining an output level of an output stack of print media in an image forming apparatus. The print media is transported, one print medium at a time, to the output stack. A sensor positioned in association with the output stack senses when the output level of the output stack has reached a near full level. At least one physical characteristic of the print media is identified which can affect the stacking of the print media. The number of the print media transported to the output stack is counted after the near full level is sensed. A determination that the output level of the output stack has reached a full level is made, dependent upon each of the at least one physical characteristic and the counted number of the print media.

11 Claims, 3 Drawing Sheets

METHOD AND SYSTEM OF SENSING AN OUTPUT LEVEL OF AN OUTPUT STACK OF PRINT MEDIA IN AN IMAGE FORMING APPARATUS

BACKGROUND OF THE INVENTION

1. Field of the Invention

The present invention relates to image forming apparatus, and, more particularly, to a method of determining a near full condition of an output bin in a printer.

2. Description of the Related Art

An image forming apparatus, such as an electrophotographic printer, typically includes at least one input tray and at least one output bin. Print media of a particular media type, such as plain paper, letterhead, card stock, envelope, label, transparency, pre-printed form, bond and/or color paper is transported from a selected input tray, through the image forming apparatus and into a selected output bin. The print media is typically discharged into the output bin at a location near the top of the output bin. For most print jobs, the depth of the output bin is sufficient to ensure that the output stack of print media does not block the discharge opening near the top of the output bin. However, for particularly large print jobs, the output stack may increase in height to a point such that the output level interferes with the discharge of subsequent sheets of the print medium, thereby possibly causing a paper jam in the printer. Moreover, it is more and more common for printers to be connected to a multi-user network, such as a local area network, in which multiple print jobs can be sent to the printer over a relatively short period of time. Unless the printer is continuously monitored, the multiple print jobs which are printed by the printer may also result in the output stack reaching an output level which is too high, thereby also resulting in a paper jam.

It is known to configure an image forming apparatus with two sensors which are positioned adjacent to an output bin. Such sensors are typically in the form of an optical sensor, although mechanical sensors having a lever arm may also be utilized. One of the sensors is actuated when the output level of the output stack in the output bin reaches a point which is below but relatively close to the full level in the output bin. Upon actuation of this sensor, the printer provides an indication to a user that the output level of the output stack in the output bin has reached a near full level. Such an indication may be a visual indication on a display panel or an audible indication such as an alarm. If the output stack is not removed from the output bin and the output level of the output stack increases within the output bin, the second sensor is positioned adjacent to the output bin to be actuated when the output stack reaches a full level within the output bin. The printer may then either provide another indication to the user that the output stack has further increased in height to the full level and/or temporarily halt operation of the printer pending removal of the output stack.

Utilizing two separate sensors as described above is adequate to provide an indication to the user of the different output levels within the printer and to inhibit paper jams associated with an output level at the full level. However, the necessity to use two separate sensors adds to the complexity and cost of the printer. Moreover, the microprocessor within the printer may need separate inputs which are respectively connected with the two sensors so that the signals may be received therefrom. The possible need for an increased number of inputs on the microprocessor also adds to the complexity and cost of the printer.

It is also known to utilize a single sensor within a printer which is positioned adjacent to an output bin and senses a near full level of the output stack within the output bin. A user may be provided with an indication that the output level of the output stack has reached a near full level upon actuation of the single sensor. Rather than utilizing a second sensor to sense the full level of the output stack, the microprocessor is configured such that a predefined number of print media sheets may be transported to the output bin after the near full level of the output stack has been sensed. The predetermined number is typically based upon an average thickness of a media type which is normally printed by the printer. For example, most print jobs require the use of plain paper with a 20 pound basis weight. Plain paper has an average thickness of about 0.004 inch. If the output bin has a maximum full level of about 500 sheets, the sensor may be positioned at an output level of the output stack corresponding to about 450 print media sheets and the predetermined number may be set to 50 such that the full level occurs after 50 print media sheets have been transported into the output bin after actuation of the near full level sensor.

A printer using a single sensor to detect the near full level of the output stack as described above works properly if the media type of the print media corresponds to plain paper. However, other media types may stack differently within the output stack in the output bin because of physical characteristics associated therewith. For example, envelopes have a thickness which is greater than the thickness of plain paper because of being folded. It is therefore not possible to transport as many envelopes into the output bin after the near full level has been sensed when compared to plain paper. On the other hand, other types of plain paper may have a basis weight and thickness which is less than 20 pound paper. It is therefore possible with thinner paper to transport more than the predetermined number of sheets into the output bin. If the predetermined number is based upon 20 pound paper, the output bin may not actually be fully utilized at the point when the full level is inferred. Moreover, certain media types have a tendency to curl after being transported through the printer and into the output bin. The print media may curl around an axis of symmetry which extends around a longitudinal axis of the print media sheet, or crosswise to the longitudinal axis of the print media sheet. The tendency of the print media to curl results in an "effective" height of the print media in the output bin which is greater than the actual thickness of the single print media sheet. A print job utilizing a print media which has a tendency to curl results in an output stack having an effective output level which is greater than the theoretical output level of the accumulated thicknesses of the sheets. Transporting the predetermined number of print media sheets having a tendency to curl therefore may result in the effective output level of the output stack being greater than the full level, thereby possibly causing paper jams in the printer.

Fig. 1 illustrates an output stack of print media exhibiting curl with an axis of symmetry about the longitudinal axis of the print media sheets. The effective output level of the output stack is a function of the curl factor, represented by the quotient of the effective thickness of the accumulated sheets ($D_{CURL}$) divided by the theoretical thickness of the accumulated print media sheets ($D_{VIRGIN}$).

What is needed in the art is an image forming apparatus which does not require multiple sensors for determination of near full and full output levels, and which more accurately predicts when the full level has been reached within an output bin.

SUMMARY OF THE INVENTION

The present invention provides a method and system of determining a near full level and full level of an output stack of print media using only one sensor, wherein the number of print media transported to the output stack after the near full level is sensed is adjusted dependent upon one or more physical characteristics of the print media.

The invention comprises, in one form thereof, a method of determining an output level of an output stack of print media in an image forming apparatus. The print media is transported, one at a time, to the output stack. A sensor positioned in association with the output stack senses when the output level of the output stack has reached a near full level. At least one physical characteristic of the print media is identified. The number of print media transported to the output stack is counted after the near full level is sensed. A determination that the output level of the output stack has reached a full level is made, dependent upon each of the at least one physical characteristic and the counted number of the print media.

An advantage of the present invention is that a full level of the output stack can be more closely approximated without the use of a second sensor.

Another advantage is that the possibility of paper jams when the output stack is at the full level can be reduced.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 2:
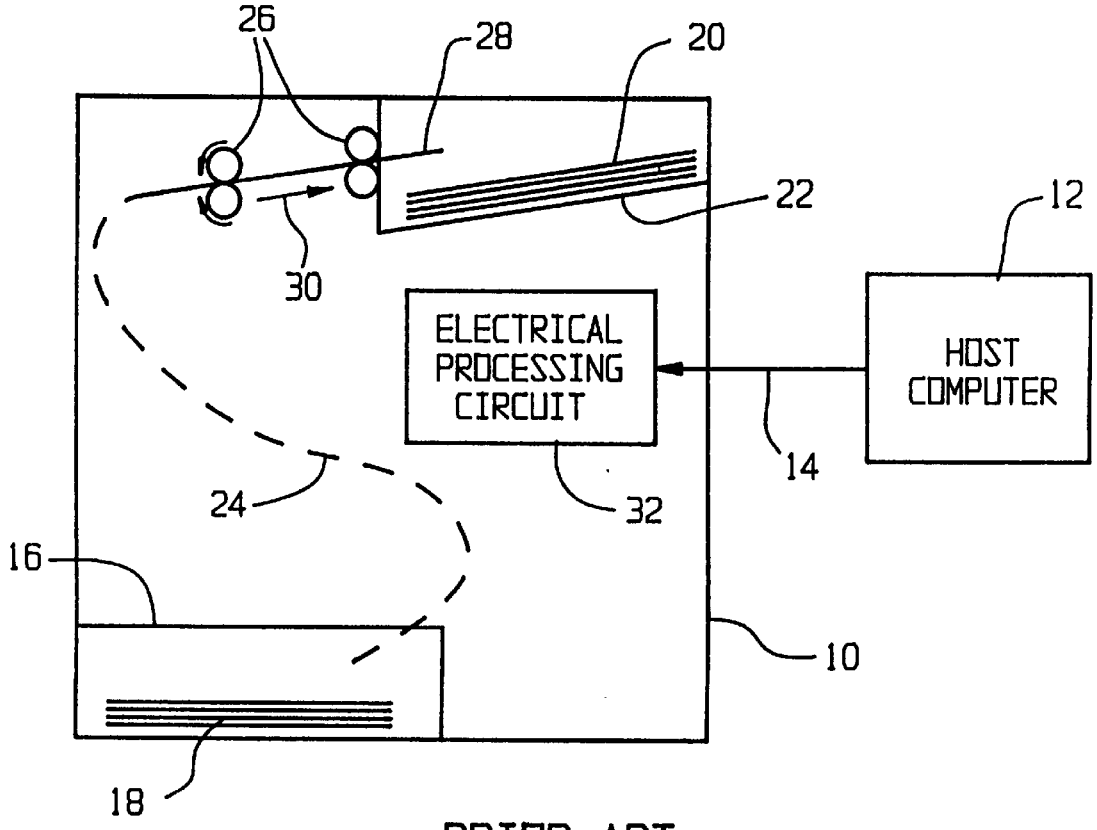
PRIOR ART Fig. 2
FIG. 2 is a schematic illustration of an electrophotographic printer which is connected with a host computer.
Figure 3:
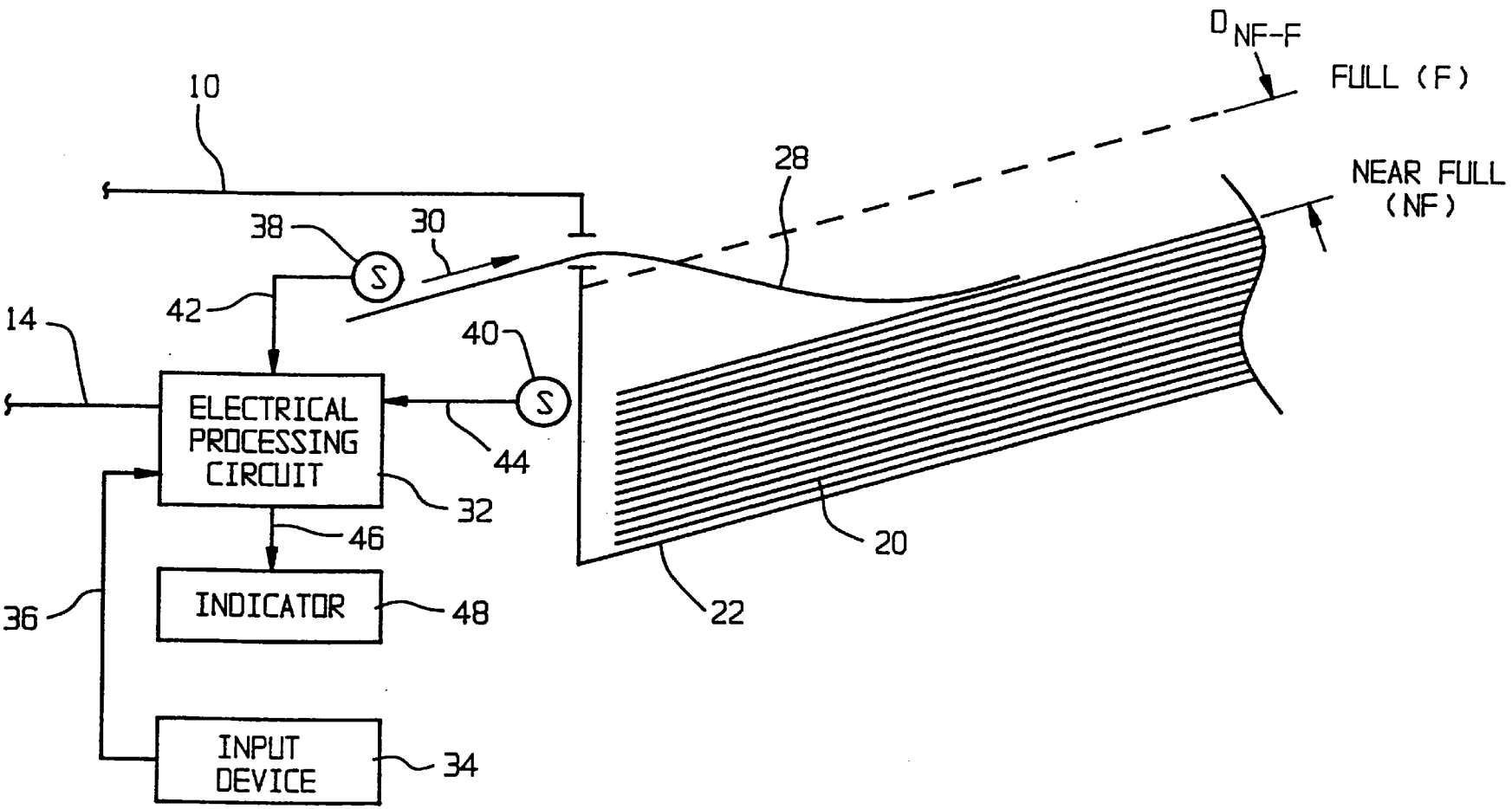
FIG. 3 illustrates in more detail the electrical components of the electrophotographic printer shown in FIG. 2, as well as a near full and full output level of the output stack in the output bin.

Referring now to the drawings, and more particularly to FIGS. 2 and 3, there is shown an embodiment of an image forming apparatus 10 which is connected with a host computer 12. In the embodiment shown, image forming apparatus 10 is in the form of an electrophotographic printer 10. However, image forming apparatus 10 may be configured other than an electrophotographic printer, such as an electrophotographic photocopier or ink jet printer. Printer 10 is connected with host computer 12 via a multi-conductor cable 14, and receives information from and transmits information to host computer 12.

Printer 10 includes an input tray 16 for holding an input stack 18 of print media of a selected media type. For example, the print media may be in the form of plain paper, letterhead, card stock, envelope, label, transparency, preprinted form, bond or colored media type. The particular media type within input tray 16 is typically input via a user through a software application which is executed by host computer 12 or from an operator panel (not shown in figure). Printer 10 may include additional input trays (not shown), with each media type being input by a user through host computer 12 or operator panel (not shown).

Figure 1:
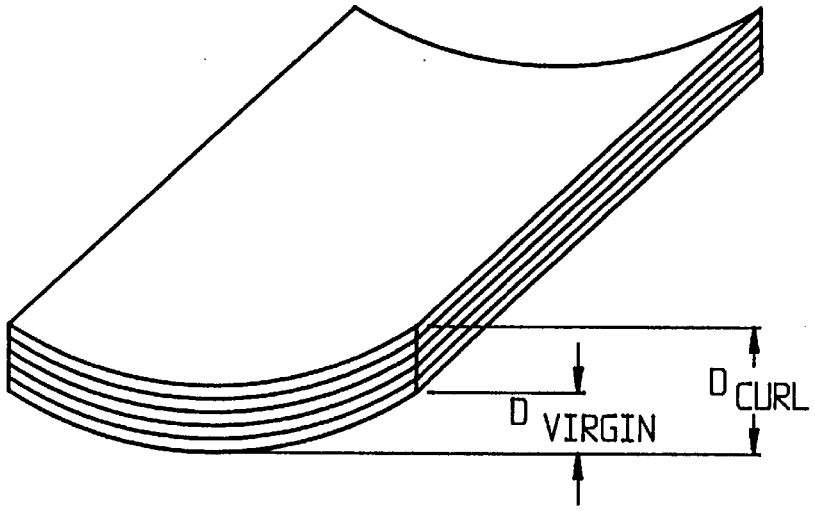
FIG. 1 illustrates an output stack of print media exhibiting curl.

Printer 10 also includes a paper transport system for transporting the print media, one print medium at a time, to an output stack 20 located within an output bin 22. The paper transport system defines a paper path through printer 10, indicated by dashed line 24. The paper transport system includes a plurality of rollers which frictionally engage each separate print medium and transport the print medium along paper path 24. Two such pairs of opposing and coacting rollers 26 within the plurality of rollers along paper path 24 are shown in FIG. 1 for illustration purposes. Roller pairs 26 rotate in the opposing directions shown, thereby causing each separate print medium 28 to move in an advance direction 30.

Electrical processing circuit 32, such as a microprocessor, controls operation of printer 10. Electrical processing circuit 32 is connected with and receives information from an input device 34 (FIG. 3), such as a user operated key pad, via a conductor 36. Input device 34 may output signals to electrical processing circuit 32 for various functions, such as diagnostic tests, reset, etc. Moreover, input device 34 may be used to input the particular media type located within each input tray, such as input tray 16 within printer 10.

Electrical processing circuit 32 also receives input signals from a leading edge sensor 38 and an output level sensor 40 via respective conductors 42 and 44. Leading edge sensor 38 may be placed at any appropriate location along paper path 24, and senses a leading edge of each individual print medium 28. For example, leading edge sensor 38 may be placed at the input side of a photoconductive drum assembly (not shown) and used to time the leading edge of each print medium 28 relative to a latent image area on the photoconductive drum.

Output level sensor 40 is positioned in association with output stack 20. More particularly, output sensor 40 is positioned in association with output stack 20 such that a signal is provided to electrical processing circuit 32 when the output level of output stack 20 reaches a near full (NF) level. Appropriate conditioning of the signal from output level sensor 40 may be necessary such that the momentary passing of a single print medium therepast does not inadvertently send a signal to electrical processing circuit 32, as each print medium 28 falls to the top of output stack 20. When no signal is received from output level sensor 40, electrical processing circuit 32 determines that the output level of output stack 20 is below the near full level. When a signal is received from output level sensor 40, electrical processing circuit 32 determines that the output level of output stack 20 is at or above the near full level. When the output level of output stack 20 is determined to be at the near full level, electrical processing circuit 32 outputs an appropriate signal via conductor 46 to an indicator 48 for indicating to a user that the near full level has been reached. Indicator 48 may be in the form of, e.g., a display panel on the front of printer 10 and/or an audible alarm.

Figure 4:
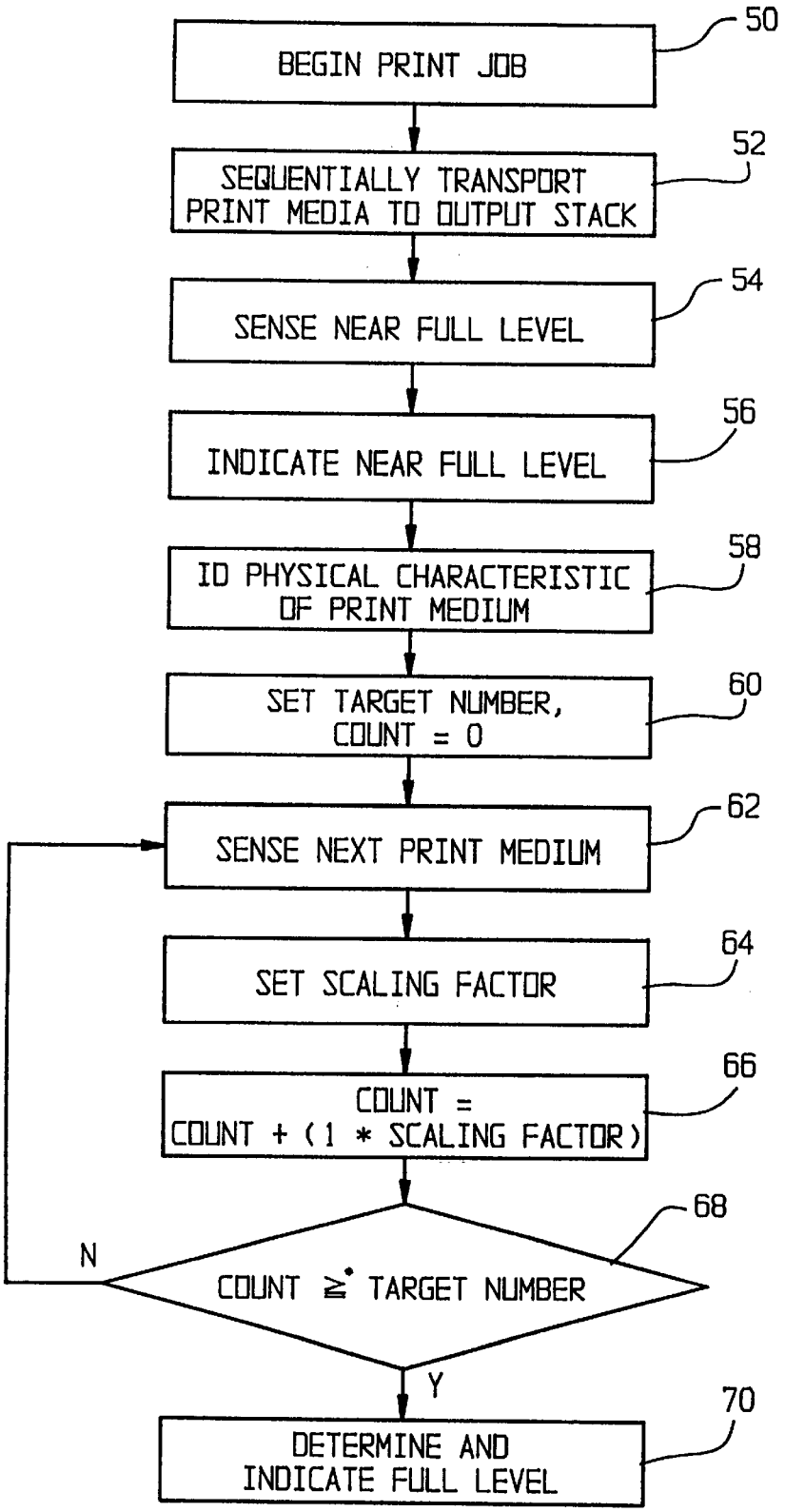
FIG. 4 is a flowchart illustrating an embodiment of the method of the present invention for determining an output level of an output stack of print media in a printer.

Referring now to FIG. 4, an embodiment of the method of the present invention for determining an output level of an output stack 20 of print media in printer 10 will be described.

At the beginning of a print job (block 50), printer 10 receives print data from host computer 12 via multi-conductor cable 14. Printer 10 sequentially transports the print media, one print medium 28 at a time, to the output stack 20 within output bin 22 (block 52). The print media sheets are sequentially transported to and deposited in output bin 22 until sensor 40 is actuated when the output level of output stack 20 reaches the near full level (block 54). Sensor 40 provides an appropriate signal to electrical processing circuit 32, which in turn may send an output signal over conductor 46 to indicator 48 to provide a visual or audible indication to a user that the near full level has been reached (block 56). The print media continue to be sequentially transported into output bin 22 immediately after sensing of the near full level.

Rather than merely transporting a predetermined number of print media sheets to the output bin 22 after the near full level has been sensed, the present invention more closely estimates when the full level has been reached by using certain inherent physical characteristics of the media type(s) for the print media which is transported into output bin 22. Typically, software within host computer 12, or input device 34, is used to configure a particular media type which is placed within and transported from a selected input tray 16. Each media type may have unique physical characteristics which affect the number of individual print media which may be transported into the output bin 22 after the near full level has been sensed. For example, a particular media type of print media may have an average thickness, curling factor, basis weight and/or texture which affects the number of print media sheets which may be transported into output bin 22 after the near full level has been sensed. Printer 10 receives the print data from host computer 12 for a particular print job, and alternatively data corresponding to a particular media type to be used during the print job, which identifies physical characteristics of the media type that may affect the number of sheets which may be stacked within output bin 22 (block 58). Alternatively, block 58 may be executed following the sensing of the next print medium (block 62). This information also can be entered via the input device 34.

A desired target number of print media sheets which may be transported into output bin 22 after the near full level has been sensed is set which typically corresponds to the number of print media sheets which may be transported into output bin 22 for the most commonly used media type, i.e., plain paper with a 20 pound basis weight (block 60). For example, with an output bin having a maximum capacity of approximately 500 sheets and an output level sensor positioned relative to an output level of about 450 sheets, the target number may be set to 50. A variable COUNT representing an adjusted number of print media sheets transported into output bin 22 after the near full level has been sensed is also set to zero. Of course, since the capacity of the output bin and sensor position relative to the output bin are known, the actual temporal placement of block 60 may be prior to that shown in FIG. 4.

As the print media sheets continue to be sequentially transported into output bin 22, the next print media sheet is sensed using sensor 38 and an appropriate output signal is transmitted to electrical processing circuit 32 (block 62). At block 64, a scaling factor which is dependent upon at least one of the physical characteristics of the print media sheets is set. The following table lists scaling factors for various media types with respective associated physical characteristics identified as virgin thickness, normalized thickness and stacking factor:

| PAPER TYPE | VIRGIN THICK-NESS | NORMALIZED THICKNESS | STACKING FACTOR | SCALING FACTOR |
|---|---|---|---|---|
| Paper (20 lb) | .004 | 1 | 1 | 1 |
| Transparency | .007 | 1.75 | 1 | 2 |
| Label | .010 | 2 | 1.5 | 3 |
| Envelope | .020 | 4 | 3 | 50 (500 sheet max.) 25 (250 sheet max.) |
| Card Stock | .095 | 2.25 | 1.5 | 3 |

The virgin thickness is an average thickness for each respective media type. The normalized thickness corresponds to a slightly adjusted ratio of the thickness of a particular media type relative to plain paper with a 20 pound basis weight. The normalized thickness for paper is thus set to 1. The stacking factor relates to a generalized stacking ability of a particular media type in the output bin of the printer. For example, an envelope includes folds and a flap which may interfere with the stacking ability of such a media type. Moreover, the curl factor of a particular media type may also affect the stacking ability thereof in the output bin of the printer. As described above, the curl factor represents a ratio between the curl height ($D_{CURL}$) of an output stack divided by a virgin thickness ($D_{VIRGIN}$) of the output stack. For media types which do not include folds or flaps, such as envelopes, the stacking factor is merely equal to the curl factor. The scaling factor approximates the product of the normalized thickness with the stacking factor, rounded to the next highest integer number. However, the scaling factor for envelopes has been adjusted substantially higher. To wit, envelopes typically are not good stacking media due to their "narrowness" (which can cause envelopes to fan out when stacked) and the fact that they have a flap which can actually separate from the envelope and interfere with subsequently stacked print media in the output bin. Accordingly, although the envelope scaling factor would otherwise be equal to 12 (the normalized thickness times the curl factor), it has nonetheless been set to a number which would allow only two envelopes to stack between near full and full as shown in the table set forth above.

At block 66, the variable COUNT is increased by additively combining the value of the scaling factor set in block 64. Thus, e.g., if COUNT equals zero (because the near full level was just sensed) and the next print media sheet is a transparency, the variable COUNT equals 0+(1*2)=2.

At decision block 68, a determination is made as to whether the value of the variable COUNT is greater than the target number set in block 60. If the accumulated value of the variable COUNT is not greater than the target number, control passes back to block 62 and the next print medium is sensed. On the other hand, if the value of the variable COUNT is greater than the target number (e.g., 25 for an output bin with a capacity of 250, or 50 for an output bin with a capacity of 500), then a determination is made that the full level exists, and a visual and/or audible indication is provided to the user (block 70).

In the embodiment shown in FIG. 4 and described above, the scaling factor is multiplied times the integer 1, with the integer 1 representing a single print medium in the output stack of print media. By setting the scaling factor for each individual print medium which is transported into output bin 22 after sensing of the near full level and thereafter multiplying the scaling factor times the integer 1, the media type of the print media which is transported into output bin 22 may vary. On the other hand, it will also be appreciated that if the media type for the media transported into output bin 22 is all of the same type and does not vary, the value of the variable COUNT can merely be increased by one each time a next print medium is sensed. Configured as such, a determination would then be made as to whether the product of COUNT multiplied by the scaling factor is greater than or equal to the target number set in block 60.

In the embodiment described above and shown in the drawings, the one or more physical characteristics of the print media which may affect the number of print media which can be transported into output bin 22 are input by the user either through host comper 12 or input device 34. However, it is also possible to position appropriate sensors within printer 10 to detect physical characteristics such as the media thickness, a transparent media, etc., for setting the scaling factor.

Although the present invention has been described with reference to preferred embodiments, those skilled in the art will recognize that changes may be made in form and detail without departing from the spirit and the scope of the following claims.

We claim:

1. A method of determining an output level of an output stack of print media in an image forming apparatus, said method comprising the steps of:

transporting the print media, one print medium at a time, to the output stack;

providing a sensor positioned in association with the output stack;

sensing when the output level of the output stack has reached a near full level using said sensor;

identifying at least one physical characteristic of the print media which affects the stacking of the print media, said at least one physical characteristic including at least one of an average thickness of each print medium, a curling factor of each print medium, a weight of each print medium, and a texture of each print medium;

counting a number of the print media transported to the output stack after said near full level is sensed using an electrical processing circuit; and determining when the output level of the output stack has reached a full level without using said sensor, dependent upon each of said at least one physical characteristic and said counted number of the print media.

2. The method of claim 1, wherein said at least one physical characteristic of each print medium is dependent upon a media type of each print medium, said media type being one of plain paper, letterhead, card stock, envelope, label, transparency, pre-printed form, bond and colored.

3. The method of claim 2, wherein each said print medium is of a same said media type.

4. The method of claim 1, comprising the further steps of:

establishing a scaling factor which is dependent upon said at least one physical characteristic; and adding said counted number of the print media with said scaling factor.

5. The method of claim 4, comprising the further step of setting a target number corresponding to a number of the print media to be transported to the output stack after said near full level is sensed; and wherein said determining step comprises determining said full level of the output stack when said added counted number is greater than or equal to said target number.

6. The method of claim 1, wherein said image forming apparatus comprises a printer.

7. The method of claim 6, wherein said printer comprises an electrophotographic printer.

8. The method of claim 1, wherein said sensor comprises an optical sensor.

9. The method of claim 1, wherein the image forming apparatus includes an output bin, and wherein the output stack is located in said output bin.

10. A system for determining an output level of an output stack of print media in an image forming apparatus, said system comprising:

means for transporting the print media, one print medium at a time, to the output stack;

a sensor positioned in association with the output stack for sensing when the output level of the output stack has reached a near full level;

means for identifying at least one physical characteristic of the print media which affects stacking of the print media, said at least one physical characteristic including at least one of an average thickness of each print medium, a curling factor of each print medium, a weight of each print medium, and a texture of each print medium;

means for counting a number of the print media transported to the output stack after said near full level is sensed using an electrical processing circuit; and means for determining when the output level of the output stack has reached a full level without using said sensor, dependent upon each of said at least one physical characteristic and said counted number of the print media.

11. The system of claim 10, wherein the image forming apparatus comprises a printer, and wherein said transporting means comprises a paper transport system.

* * * * *